United States Patent [19]

Nelson, Jr.

[11] 3,981,618

[45] Sept. 21, 1976

[54] METHOD AND APPARATUS FOR PREVENTING PUMP CAVITATION

[75] Inventor: George R. Nelson, Jr., New York, N.Y.

[73] Assignee: Grumman Aerospace Corporation, Bethpage, N.Y.

[22] Filed: Feb. 14, 1975

[21] Appl. No.: 550,042

[52] U.S. Cl. ..... 417/12; 169/24; 415/17; 417/23; 417/27; 417/34; 417/42

[51] Int. Cl.[2] ..... F04B 49/08

[58] Field of Search ..... 417/12, 23, 34, 43, 417/17–20, 22–24, 26, 34, 42, 12; 169/13, 24; 415/27, 1, 17

[56] References Cited

UNITED STATES PATENTS

| | | | |
|---|---|---|---|
| 2,384,420 | 9/1945 | Griswold | 417/12 X |
| 2,707,440 | 5/1955 | Long et al. | 417/12 |
| 2,989,000 | 6/1961 | Alcaro | 417/20 X |
| 3,544,235 | 12/1970 | Smith | 417/34 X |
| 3,567,338 | 3/1971 | Edwards | 417/34 |
| 3,572,959 | 3/1971 | Shaughnessy | 417/22 X |
| 3,614,761 | 10/1971 | Rehm et al. | 417/43 X |
| 3,617,151 | 11/1971 | Scroggins | 417/18 |
| 3,781,907 | 12/1973 | Gerber | 417/42 X |
| 3,786,869 | 1/1974 | McLoughlin | 417/34 X |
| 3,811,789 | 5/1974 | Randell | 415/1 |
| 3,828,814 | 8/1974 | Neumann et al. | 415/17 X |
| 3,864,059 | 2/1975 | Smith | 417/20 |

*Primary Examiner*—William L. Freeh
*Assistant Examiner*—Edward Look
*Attorney, Agent, or Firm*—Morgan, Finnegan, Pine, Foley & Lee

[57] ABSTRACT

The speed of an engine driven pump is sensed and compared with the desired maximum operating speed to detect overspeed. The discharge of the pump is controlled by a variable flow rate controller. When an overspeed condition exists, a command signal is sent to the discharge controller to reduce flow by a discrete decrement. The control signal is blocked after activating the controller for a preselected time interval. During the blocking interval the engine speed is maintained substantially at the operating speed by cyclical reduction of the power input thereto.

10 Claims, 3 Drawing Figures

METHOD AND APPARATUS FOR PREVENTING PUMP CAVITATION

The present invention relates to a method and apparatus for preventing pump cavitation, and more particularly to the prevention of fire pumper pump cavitation.

BACKGROUND OF THE INVENTION

Cavitation is a phenomena which occurs in fluids when the pressure in the fluid drops below the vapor pressure and occurs in fire engine pumps when the hose water demand exceeds the water available. Cavitation manifests itself by the presence of gas in the fluid. When cavitation is extensive a large void ratio is created in the fluid which may result in instability, vibration and noise. The presence of cavitation in an engine driven pump is known to create pitting of the internal parts of the pump. Even more importantly, mild cavitation reduces the flow rate discharge and pressure of the pump and, if these quantities are control parameters, the speed of the engine may be increased to return them to the designed level. The increase in engine speed, (and pump speed) however, further aggrevates the condition by further reducing fluid pressure and increasing cavitation. Thus, the pump can "lose" water and the flow rate drops dramatically, sometimes to zero.

Fire pumper trucks are now in general use and are designed to increase the pressure of water available at a hydrant and deliver it through a plurality of hoses to firemen (nozzlemen) who are located by a fire. Generally, the site of the fire is quite remote from the pumper, and thus hoses of up to several hundred feed are utilized.

As the fire is being sprayed, the nozzlemen relay commands back to the pumper for increases and decreases in flow rate. As the total flow rate to the nozzlemen is increased in response to commands, the speed of engine driven pump is increased. Now, if the demand for water exceeds the available supply, it can result in pump cavitation and a drop in flow rate. If cavitation occurs, water will be supplied in reduced quantity to the nozzlemen and may even cease. It will be readily appreciated that the loss of water may trap the nozzlemen in the fire with no means of escape.

PRIOR ART

Various control systems have been proposed in the past for regulating pressure in an engine driven pump. Such devices are disclosed in the following U.S. Pat. Nos.: Sherbondy, 1,419,316; Morrow, 2,966,120; Edwards 3,050,003; Clark, 3,378,191; Reiss, 3,514,217; and Kennedy, Jr., 3,811,792. And, it has been suggested that discharge pressure be used to control engine speed in fire pumpers. See Griswold, 2,609,755; Barklow, 2,691,941; and McLoughlin, 3,786,869.

However, the prior art has not been directed to the prevention of cavitation in fire pumpers to assure personal safety of the nozzlemen and maintaining flow in the event of cavitation excursions.

SUMMARY OF THE INVENTION

The present invention is directed to a method and apparatus for controlling an engine driven pump to prevent cavitation and maintain a source of fluid discharge despite pump overspeed. The invention is particularly adapted for fire pumpers in which an engine driven pump supplies high pressure water to one or more hoses.

The method and corresponding apparatus include sensing the engine speed and comparing it to the desired maximum operating speed. If the sensed speed is greater than the maximum operating speed a command signal is provided to control the engine and pump discharge. The command signal triggers a pulse generator which causes the discharge flow rate to be decreased one decrement. Simultaneously, the energy input to the engine is decreased by reducing the fuel supplied or grounding the ignition of the engine.

When the engine speed drops below maximum operating speed, the control of the engine is returned to the normal governor system.

After the discharge rate has been lowered one decrement, further command signals are blocked for a period of time in the range 5–10 seconds to allow the flow rate to stabilize. During this interval the energy input is continuously controlled to cause the engine speed to, in effect, oscillate below the maximum speed. Thus, while the flow rate is gradually decreased, optimum pumping speed is maintained. When the discharge is terminated, the system reduces engine speed to idle.

DETAILED DESCRIPTION OF A PREFERRED EMBODIMENT

Figure 1:
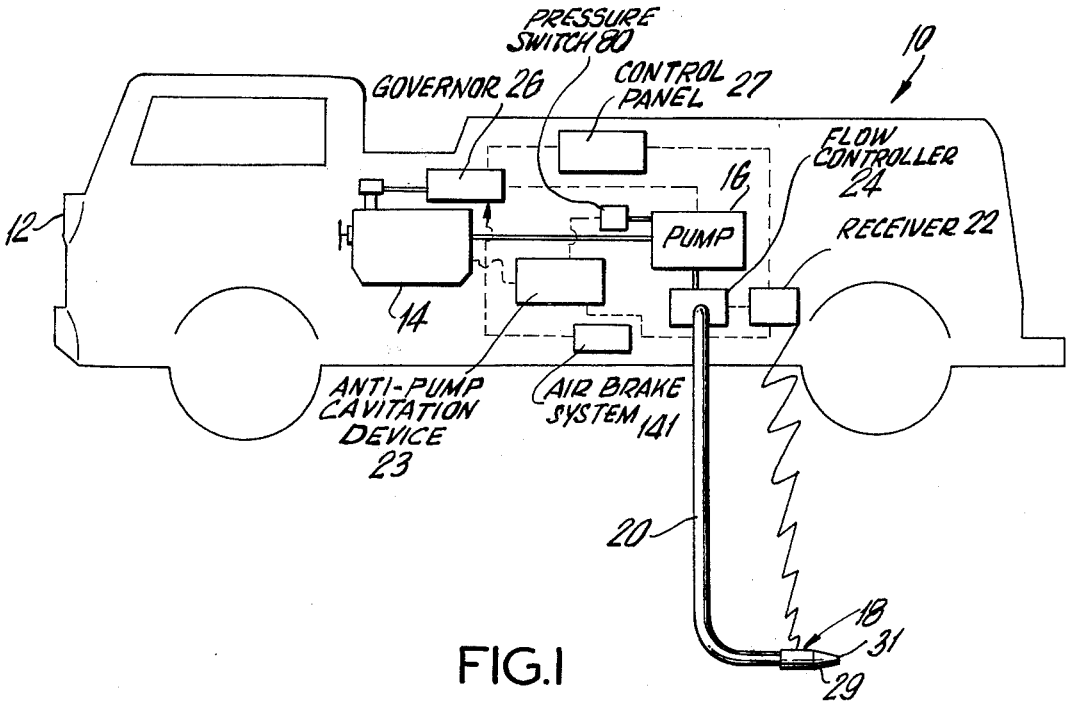
FIG. 1 is a block diagram of a fire pumper truck equipped with an anti-cavitation device of the present invention.

While this invention is susceptible of embodiment in many different forms, there is shown in the drawings and will hereinafter be described in detail a preferred embodiment of the invention and modifications thereto, with the understanding that the present disclosure is to be considered as an exemplification of the principles of the invention and is not intended to limit the invention to the embodiment illustrated.

FIG. 1 illustrates a comprehensive fire hose flow rate control system generally indicated at 10. The system 10 is mounted in a fire pumper truck 12 for use in conjunction with an engine 14 and associated pump 16. The system includes a remote digital encoder transmitter 18 mounted at the nozzle 31 of a fire hose 20, a receiver 22 mounted on truck 12, a flow controller 24 electrically coupled to the receiver 22 and mechanically coupled to the pump 16, a governor 26 mechanically coupled to engine 16, and a control panel 27 mounted on the truck and coupled to the governor 26, receiver 22 and anti-cavitation device 23.

The apparatus of the entire control system in which the device of this invention is preferably incorporated is disclosed and fully described in commonly assigned, co-pending, U.S. application Ser. NO. 550,044, filed Feb. 14, 1975. The nozzle coupler 29 used with the control system is disclosed in commonly assigned, co-pending U.S. application Ser. No. 550,041, filed Feb. 14, 1975 now U.S. Pat. No. 3,943,312.

The anti-cavitation device 23 may be used in several types of flow control systems; this illustrated system is an exemplary embodiment. Briefly, for the purposes of background understanding of control system 10 digital control signals corresponding to the water flow rate requirements of a nozzleman are transmitted from encoder 18 to receiver 22. The receiver decodes the signal and operates flow controller 24 to change a valve position and thus deliver water at the desired flow rate.

Figure 2:
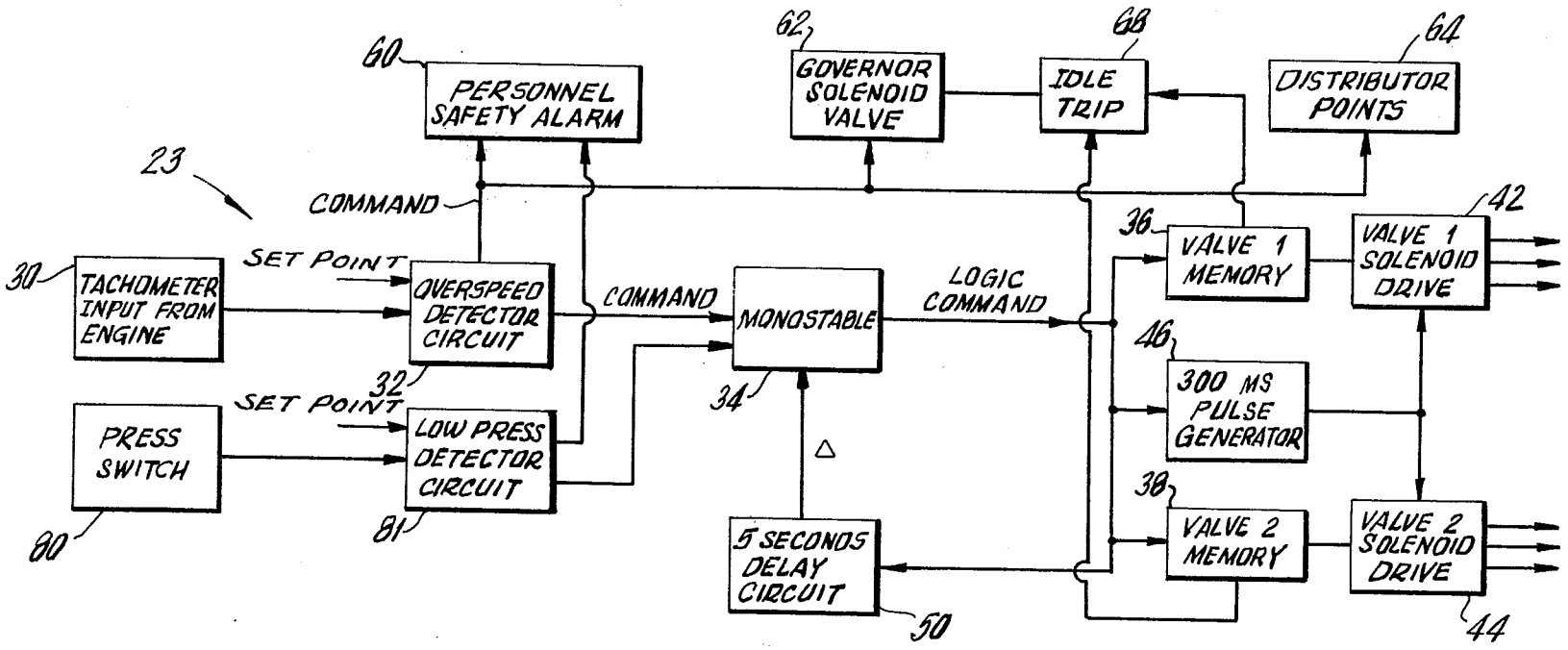
FIG. 2 is a block diagram of an anti-cavitation device for use with the apparatus in FIG. 1.

Referring now to FIG. 2, the anti-cavitation device 23 utilizes engine speed as the control parameter. To this end, a sensor 30 is coupled to engine 14 to generate a signal proportional to the speed of the engine. The particular type of sensor 30 depends on the type of engine; i.e. gasoline internal combustion or diesel, and the type of signal to be generated.

Where a gasoline engine is used, an electrical tachometer may be coupled to the ignition system to generate the signal. The signal generated by the tachometer depends on the circuitry thereof and may be of the current, pulse frequency or A.C. type, as is known in the art. If a diesel engine is used, a mechanical unit, nown as a tach sending unit, is coupled to the engine and generates a signal proportional to engine speed. One type of tach sending unit suitable for use is the model 702 sold by Auto Meter Products, Inc. 22 S. State Street, Elgin, Ill., 60120.

The signal proportional to the engine speed is sent to an overspeed detector circuit 32 which compares the sensed speed to a predetermined set speed corresponding to the maximum operating speed. It will be appreciated that the engine 14 is coupled to pump 16 through a suitable transmission so that the known transmission ratio when applied to the sensed engine speed yields the pump speed. It should be noted that, in addition to cavitation in the pump, engine overspeed may result in "floating" the valve in the engine, overheating and seizure of the systems.

The overspeed detection circuitry is arranged to provide a command signal for controlling engine speed and discharge flow rate in the event of engine overspeed. The cavitation results, as discussed above, from an over demand on water flow rate which causes a decrease in pump discharge pressure. The governor 26 immediately increases engine speed to restore output pressure. If this process was continued, the engine speed would exceed the maximum speed for the engine. The pump 16 is designed to deliver water at speeds up to the maximum engine speed without cavitation if suitable water supply is available to the pump. Therefore, the speed of engine must be maintained at or below the maximum operating speed.

Alternatively to increase in flow demand, the available water supply from the hydrant may drop as a result of greater demand on the water line from additional pumpers. This decrease in available hydrant water may also result in engine overspeed cavitation and abrupt loss of water.

The overspeed detector circuit is thus operative to generate a command signal when maximum engine speed is exceeded. The structure of the circuitry depends on the signal from sensor 30, as described above, and easily constructed by those skilled in the electronics art. The circuitry may either directly pass the sensor signal through as a command signal and generate a command signal by amplification. The term "generate" as used herein thus refers to the signal output from the overspeed detection circuitry whether passed through or produced thereby.

The command signal serves two functions, namely, flow rate control and engine control. To this end, the command signal is transmitted to a monostable device 34 having a "yest"-"no" logic, such as a C/MOS clip, sold by RCA under the designation CD4047AE. The monostable in turn transmits the logic command signal to a control system in decoder/receiver 22, which is powered by the truck battery (not shown) at 14 volts d.c.

The logic command is solely to decrease the water discharge flow rate. The flow rate in each hose is directly controlled by a multi position valve, 40 described below. The existing valve status for valves 1 and 2 (assuming a two hose pumper with a single valve 40 for each hose) is stored in valve memory 36 and valve 2 in memory 38. The incoming logic command serves as a signal to valve memories 36 and 38 (binary up/down counter). Valve memories 36 and 38 are thus decreased by one count by the logic command signal.

To decrease each hose valve by one decrement, 300 millisecond drive pulse are simultaneously applied to solenoid drivers 42 and 44 from a pulse generator 46 triggered by the logic command signal.

Figure 3:
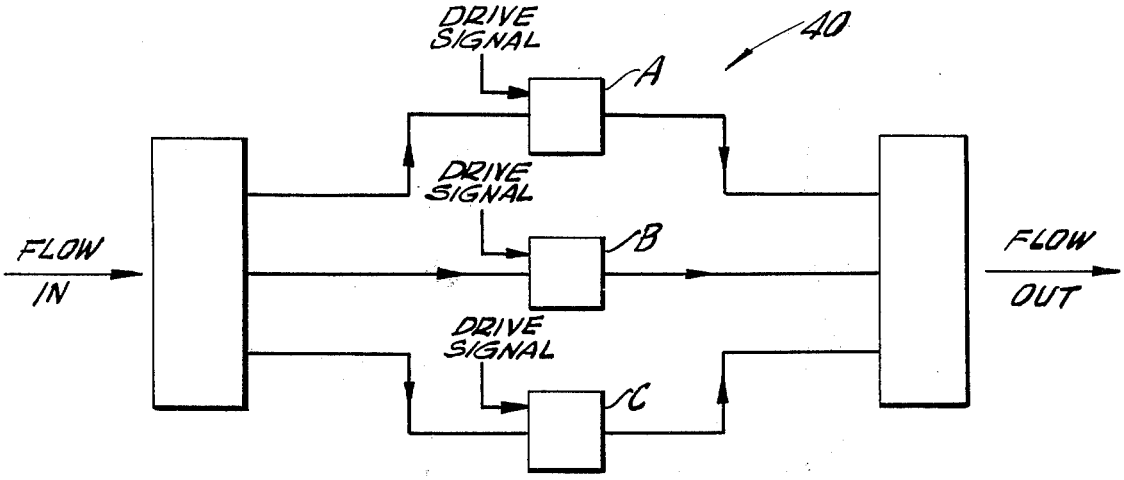
FIG. 3 is a block diagram of a multi-position control valve.

Referring to FIG. 3, each solenoid driver 42 and 44 operates the flow control valve 40 of each hose 20. Each flow control valve 40 includes three constant flow sections A, B, and C, having common inlets and outlets, whose flows may be combined to obtain different flow rates. Such a multi-position flow control valve is available from AiResearch Manufacturing Company as Model No. SCCAD–012–100–1. Preferably section A has a flow rate of 45 GPM, section B a flow rate of 90 GPM, and section C a flow rate of 175 GPM. Thus, with various combinations of sections A, B, and C, the following flow rates can be obtained: 45, 90, 135, 175, 220, 265, and 310 GPM.

The decrease by one decrement in each valve memory causes the 300 millsecond pulse to be applied to the proper combination of solenoid valves which control sections A, B, and C. For example, if the flow rate 0, 45, 90 GPM correspond to logic 000, 001, 010, respectively, and valve 1 is at 45 GPM and valve 2 is at 90, the logic command signal will decrement the memories one level from 001 to 000 and 010 to 001, respectively. Thus, valve 1 will be closed by the pulse and valve 2 set to 45 GPM.

The logic command signal also is fed to a delay circuit 50. Circuit 50 is designed to block further operation of the monostable 34 for a preselected time interval from 5 to 10 seconds, preferably 5 seconds. This delay allows the flow in each hose to stabilize while control of engine speed continues.

In addition to controlling the flow rate discharge, the command signal trips a personnel safety alarm 60, which annunciates the existence of an overspeed, and reduces the power input to engine 14. Power input to the engine is reduced by signaling the governor solenoid valve 62 to decrease the fuel input, or, in the case of gasoline engines, by grounding the ignition points 64. In this manner, the engine speed is reduced to a level below the maximum engine speed. The governor valve is reopened (or ignition ungrounded) when the engine speed is at or below the maximum engine speed. Now, since the governor may again cause the engine to overspeed, the overspeed detector circuit 32 will again reduce power input to the engine. Thus, while the discharge flow rate is reaching steady state, the engine speed may be oscillated about the maximum speed. This method of control, enables maximum discharge pressure to be maintained without engine or pump damage, while the discharge flow rate is brought back to or below the available supply rate from the hydrant.

Advantageously, the valve memories 36 and 38 energize an idle trip circuit 68 to reduce the engine speed to idle when the discharge flow rate has been terminated in all hoses.

From the above description it will be apparent that other modifications may be made to the device without departing from the spirit and scope of applicant's invention as pointed out in the appended claims. One such modification is the addition of a low pressure switch 80 and detector circuit 81 in the water supply line at or near the inlet to the pump. This switch serves to initiate the anti-cavitation sequence described above in a manner similar to the RPM sensing circuitry. The sequence of events initiated by switch 80 would be the same as that for an engine overspeed condition except that it would not be required to reduce engine speed.

The purpose for switch 80 is to prevent the fire pumper from lowering the water pressure in the water mains and thereby preventing possible damage to the mains and other devices being supplied water from the same mains. Switch 80 also prevents pump cavitation from occurring when the water supply is insufficient and the engine has not yet been cause to overspeed.

Switch 80 and detector circuit 81 also include means for being 'overridden' when the pumper is taking its water from an open supply rather than a pressurized source.

What is claimed is:

1. A method of controlling a system having a pump driven by an engine, said pump having a discharge conduit with a variable flow rate controller to prevent cavitation due to engine overspeed comprising the steps of: continuously sensing the speed of said engine and comparing the speed to a preselected set point speed; generating a command signal when said sensed speed exceeds said set point speed; actuating said flow controller with said command signal to change the flow rate of said discharge conduit by a predetermined decrement; subsequently blocking said command signal from activating said flow controller for a selected time interval to permit the flow rate to reach steady state, while reducing energy input to the engine to cause said engine speed to drop below said set point speed, whereby said engine speed is maintained substantially at said set point speed to prevent cavitation in the pump.

2. The method of claim 1 wherein said energy reducing step is performed by decreasing the flow of fuel to the engine.

3. The method of claim 1 wherein said energy reducing step is performed by momentarily terminating the ignition of said engine.

4. The method of claim 1 wherein said predetermined time interval is an interval having a duration of from 5 to 10 seconds.

5. The method of claim 4 wherein said duration is 5 seconds.

6. The method of claim 1 further including the step of energizing an alarm when said sensed speed exceeds said set speed.

7. The method of claim 1 further including the step of reducing said engine speed to idle when said discharge flow rate is terminated.

8. Apparatus for controlling a system having a pump driven by an engine, said pump having a discharge conduit with a variable flow rate controller to prevent cavitation due to engine overspeed comprising: means for sensing the speed of said engine and generating a signal output proportional thereto; comparator means electrically coupled to said sensing means to derive a signal input therefrom, said comparator means being operative to compare said signal input with a predetermined value corresponding to the maximum operating speed of the engine and generate a command signal when said engine speed exceeds said maximum operating speed; control means operatively coupled to said variable flow rate controller, said control means being adaptable and arranged to receive said command signal and actuate said controller to change the flow rate in said discharge conduit by a predetermined decrement, said control means including means for interrupting the response thereof, to said command signal for a preselected interval following activation of said controller to permit the flow rate to reach steady state conditions; and engine control means adapted to derive an input from said command signal and reduce the energy input to the engine to cause said engine speed to drop below said maximum operating speed, whereby said engine speed is maintained substantially at said operating speed to prevent cavitation.

9. Apparatus of Claim 8 wherein said engine is a gasoline internal combustion engine and said engine control means is adapted and arranged to ground the ignition thereof.

10. Apparatus of claim 8 wherein said variable flow rate controller includes a discharge conduit having three parallel flow branches, said branches being arranged to permit flow rates therethrough corresponding to integer multiples of said decrement, each of said branches having a control valve, said control means being operatively coupled to said control valves, whereby said discharge flow rate is reduced in response to overspeed of the engine.

* * * * *